US008675033B2

(12) United States Patent
Kimura et al.

(10) Patent No.: US 8,675,033 B2
(45) Date of Patent: Mar. 18, 2014

(54) RECORDING APPARATUS

(71) Applicant: Seiko Epson Corporation, Tokyo (JP)

(72) Inventors: Naomi Kimura, Okaya (JP); Tetsuya Miyagawa, Shiojiri (JP); Kenji Oshima, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/747,087

(22) Filed: Jan. 22, 2013

(65) Prior Publication Data

US 2013/0188001 A1 Jul. 25, 2013

(30) Foreign Application Priority Data

Jan. 23, 2012 (JP) ..... 2012-011005

(51) Int. Cl.
*B41J 29/02* (2006.01)

(52) U.S. Cl.
CPC ..... *B41J 29/02* (2013.01)
USPC ..... 347/222

(58) Field of Classification Search
CPC ..... B41J 29/13
USPC ..... 347/108, 197, 220, 222
See application file for complete search history.

(56) References Cited

U.S. PATENT DOCUMENTS

| | | | | |
|---|---|---|---|---|
| 6,494,631 | B1 * | 12/2002 | Mastinick | 400/208 |
| 7,651,287 | B2 * | 1/2010 | Numata et al. | 400/120.01 |
| 8,016,412 | B2 * | 9/2011 | Kawai et al. | 347/108 |
| 8,189,025 | B2 * | 5/2012 | Mori et al. | 347/220 |
| 8,382,277 | B2 * | 2/2013 | Chinzei et al. | 347/108 |
| 8,419,302 | B2 * | 4/2013 | Watanabe et al. | 400/120.16 |
| 8,562,231 | B2 * | 10/2013 | Maeda et al. | 400/663 |
| 2006/0029424 | A1 * | 2/2006 | Kawai et al. | 399/125 |
| 2007/0002290 | A1 * | 1/2007 | Muraki et al. | 353/119 |
| 2007/0292159 | A1 * | 12/2007 | Iijima | 399/110 |
| 2008/0157639 | A1 * | 7/2008 | Jeong et al. | 312/237 |
| 2009/0244249 | A1 | 10/2009 | Chinzei et al. | |

FOREIGN PATENT DOCUMENTS

JP 2009-239752 10/2009

* cited by examiner

*Primary Examiner* — Huan Tran
(74) *Attorney, Agent, or Firm* — Workman Nydegger

(57) ABSTRACT

An ink jet printer includes an openable/closable scanner unit which is provided in an upper portion of a recording unit configured to execute recording on a sheet. A shaft is formed on a main frame which constitutes a base of the recording unit. The scanner unit is enabled to tilt in relation to the recording unit when the bearing provided to the scanner unit engages the shaft. A restricting portion is provided at a location opposing the outer periphery of the bearing. The restricting portion restricts the deformation of the bearing in a direction of expansion of an opening of the bearing within the range of tilt of the scanner unit.

5 Claims, 13 Drawing Sheets

RECORDING APPARATUS

BACKGROUND

1. Technical Field

The present invention relates to a recording apparatus, such as a facsimile apparatus or a printer. In particular, the invention relates to a recording apparatus including a pivotable member, which is pivotably provided in an upper portion of the apparatus body and which can be opened and closed by tilting.

2. Related Art

Recording apparatuses, such as a facsimile apparatus and a printer, include a multifunction peripheral (MFP) having an image reading function in addition to a recording function. More specifically, an MFP includes a scanner unit provided in an upper portion of a body of the recording apparatus that executes recording on a recording sheet.

The scanner unit is pivotable in relation to the recording apparatus body. The posture of the scanner unit can be shifted between an open posture and a closed posture by tilting. In the state of normal use of the recording apparatus, the closed posture of the scanner unit is maintained. On the other hand, the scanner unit is opened during removal of a jam, which is executed if a paper jam has occurred inside the recording apparatus body, or in replacement of an ink cartridge, for example.

JP-A-2009-239752 is an example of the related art.

In some cases, a connection portion, which is a portion for connecting a scanner unit that is a pivotable member with the recording apparatus body pivotably in relation to the recording apparatus body, includes a shaft and a bearing that can be engaged with the shaft. In other cases, in order to improve the ease with which a scanner unit can be connected to the recording apparatus body, an opening is formed in a bearing, which is made of a resin material and the like, so that the opening expands (i.e., so that the bearing is elastically deformed) at the moment the bearing is engaged with the shaft.

However, if the above-described opening is formed in the bearing to improve the ease with which the bearing can be engaged with the shaft, the bearing may not be tightly engaged with the shaft. Accordingly, in this case, the bearing may relatively easily disengage from the shaft.

SUMMARY

An advantage of some aspects of the invention is that a recording apparatus has a pivotable connecting structure including a shaft and a bearing and capable of maintaining a tight engagement between the shaft and the bearing while improving the ease with which the bearing can be engaged with the shaft.

According to an aspect of the invention, a recording apparatus includes an apparatus body including a recording unit configured to execute recording on a medium, a pivotable member provided pivotably in an upper portion of the apparatus body and whose posture can be shifted between an open posture and a closed posture by tilting, and a connection portion configured to connect the apparatus body with the pivotable member. In the recording apparatus, the connection portion includes a shaft and a bearing having an opening formed in one part thereof in a peripheral direction and which can be engaged with the shaft by deforming in a direction of expansion of the opening occurring at the moment the bearing is engaged with the shaft, and a restricting portion is provided, which is configured to restrict deformation of the bearing in the direction of expansion of the opening within a range of tilt between the open posture and the closed posture of the pivotable member, at a location opposing an outer periphery of the bearing.

According to the present aspect, because the restricting portion configured to restrict deformation of the bearing in the direction of expansion of the opening within the range of tilt between the open posture and the closed posture of the pivotable member is provided at a location opposing the outer periphery of the bearing, disengagement of the bearing from the shaft, which may occur due to expansion of the opening, can be prevented within a range of use of the pivotable member, i.e., the range of tilt of the pivotable member between the open posture and the closed posture.

It is preferable, in the recording apparatus according to the aspect, that the restricting portion have an arc-like shape formed along the outer periphery of the bearing. Accordingly, deformation of the bearing can be appropriately restricted throughout the extent of the outer periphery of the bearing because the restricting portion has an arc-like shape formed along the outer periphery of the bearing.

It is preferable, in the recording apparatus according to the aspect, that the shaft have a shape whose outer periphery is partially cut out. Accordingly, because the shaft has a shape whose outer periphery is partially cut out, only a small amount of elastic deformation of the bearing is required to engage the bearing with the shaft by engaging the bearing with the shaft along the direction of extension of a chord formed by the cutout. Therefore, the ease with which the bearing can be engaged with the shaft can be improved.

It is preferable, in the recording apparatus according to the aspect, that the bearing have a shape whose outer periphery is partially cut out. Accordingly, because the bearing has a shape whose outer periphery is partially cut out, degradation of the ease with which the bearing can be engaged with the shaft, which may occur due to otherwise possible interference of the outer periphery of the bearing with surrounding components, can be prevented.

It is preferable, in the recording apparatus according to the aspect, that a guiding portion extending from the opening toward an outside of the bearing in a radial direction of the bearing and configured to guide the shaft toward the inside of the opening be provided.

Accordingly, because the guiding portion extending from the opening toward the outside of the bearing in the radial direction of the bearing and configured to guide the shaft toward the inside of the opening is provided, the ease with which the bearing can be engaged with the shaft can be improved as a result of the bearing being guided toward the shaft by the guiding portion extending from the opening toward the outside of the bearing in the radial direction of the bearing when engaging the shaft with the bearing.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinbelow, an exemplary embodiment of the invention will be described with reference to the attached drawings. Note that the invention is not limited to exemplary embodiments of the invention described below. More specifically, the invention can be implemented by various modifications within the scope of the invention as defined in the claims appended hereto. An exemplary embodiment of the invention will be described based on the premise that such modifications are included in the scope of the invention.

Figure 1:
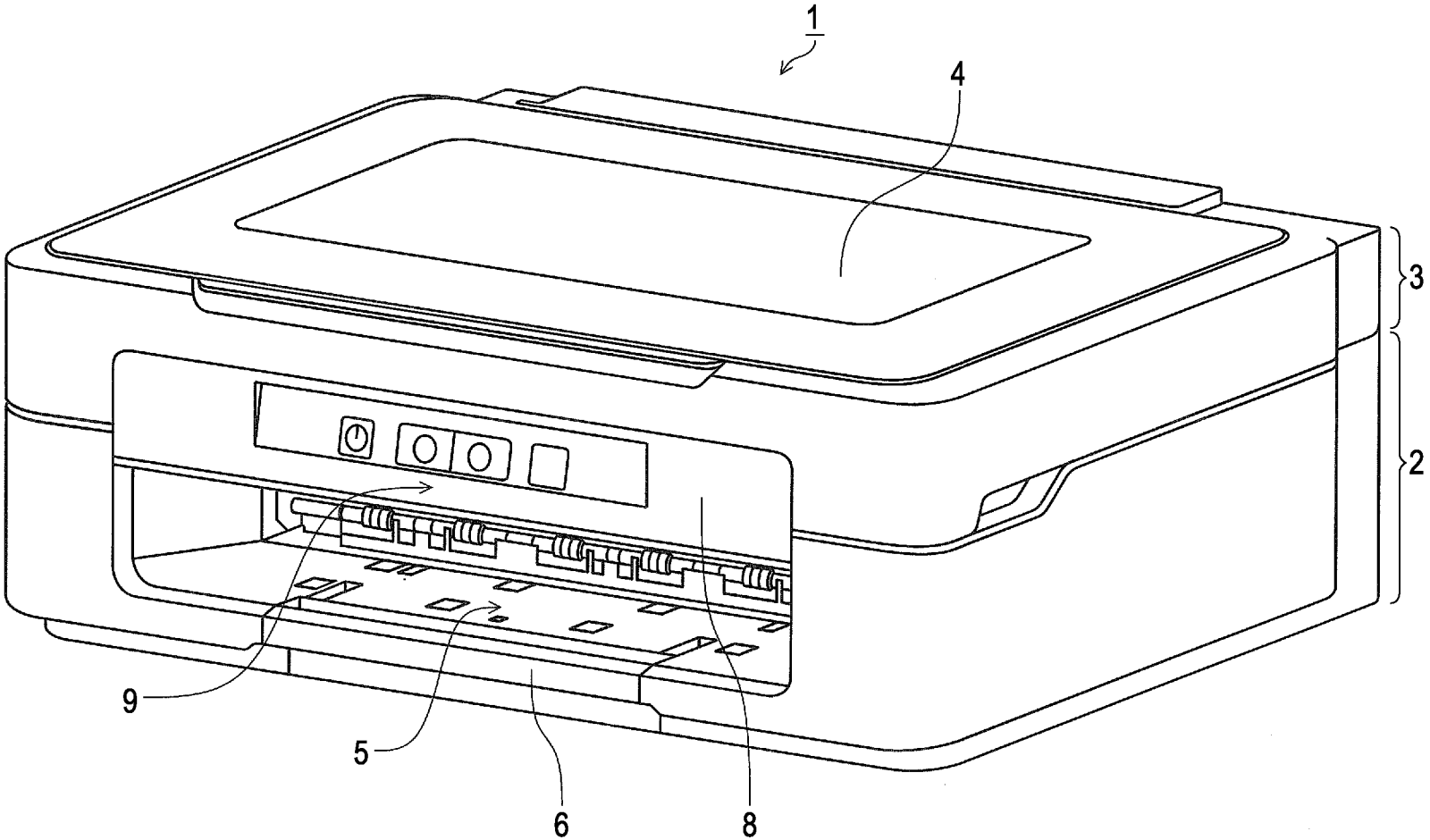
FIG. 1 is an external perspective view illustrating an ink jet printer according to an exemplary embodiment of the invention in a scanner unit closed state.
Figure 2:
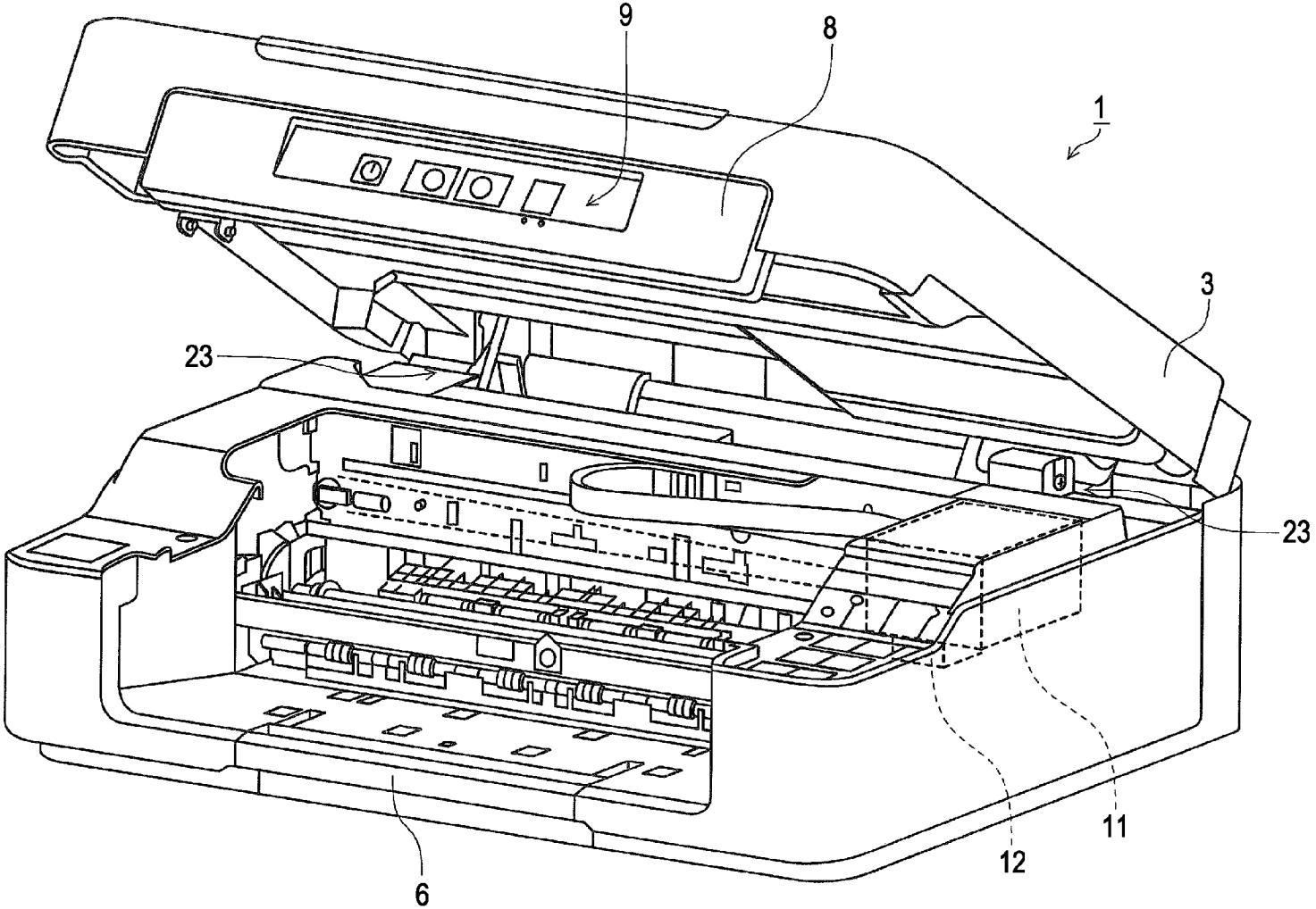
FIG. 2 is an external perspective view illustrating the ink jet printer according to an exemplary embodiment of the invention in a scanner unit open state.
Figure 3:
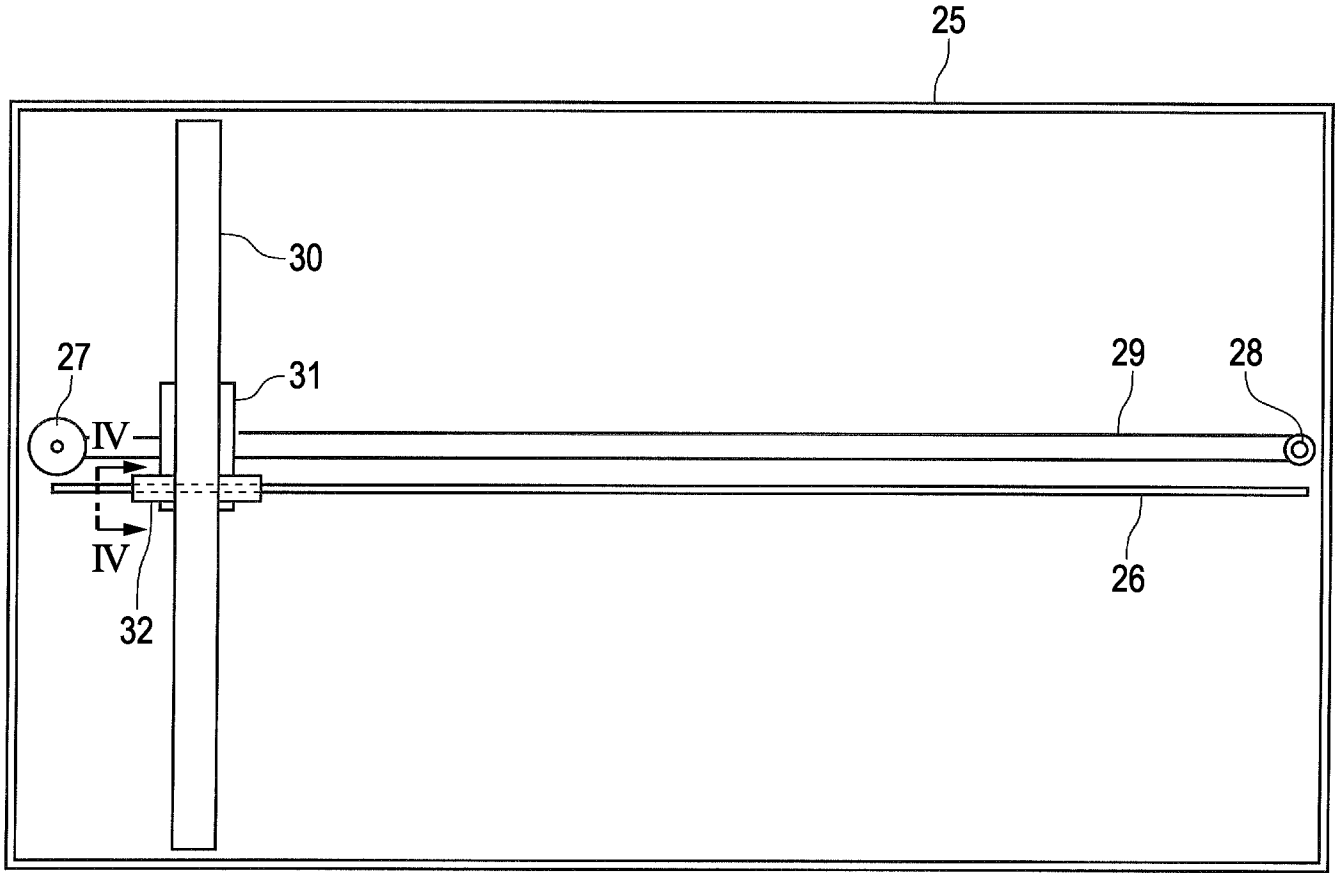
FIG. 3 is a plan view of the scanner unit.
Figure 4:
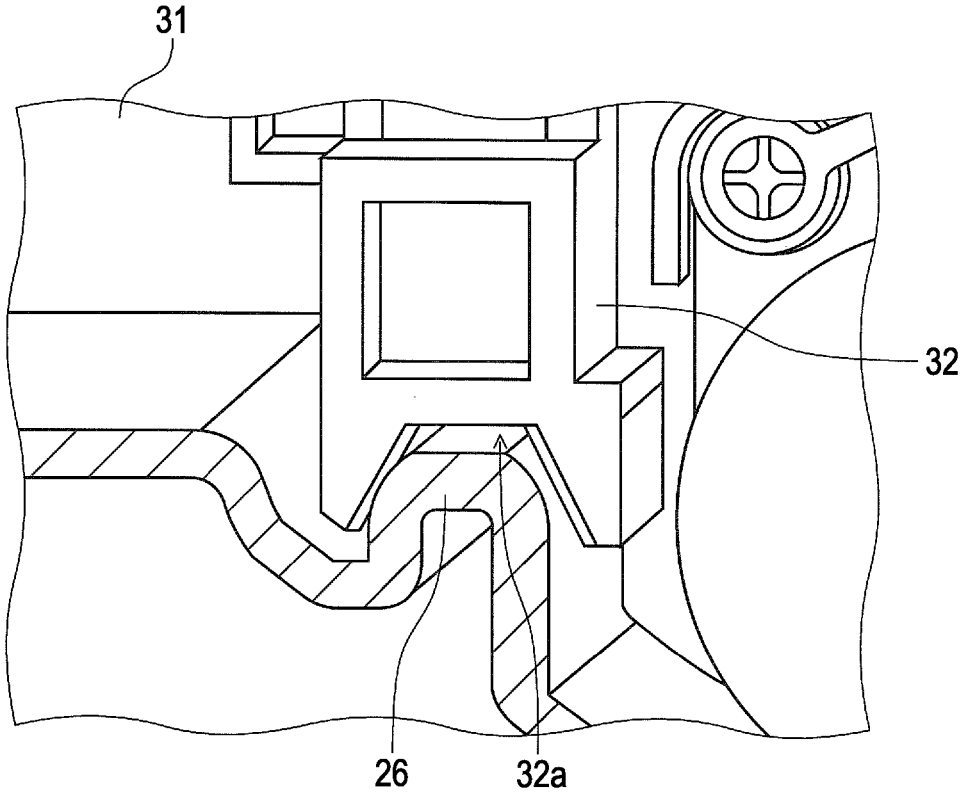
FIG. 4 is a perspective cross-sectional view of the scanner unit illustrated in FIG. 3 along section IV-IV.
Figure 5:
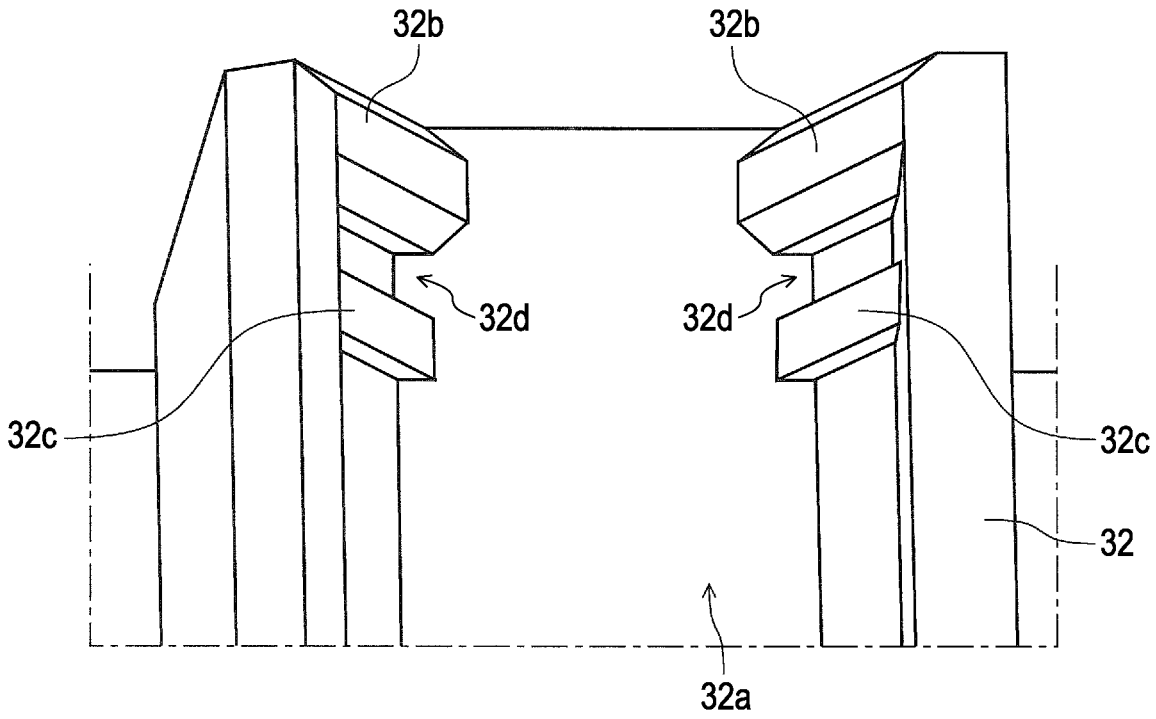
FIG. 5 is a perspective view illustrating a guided portion.
Figure 6:
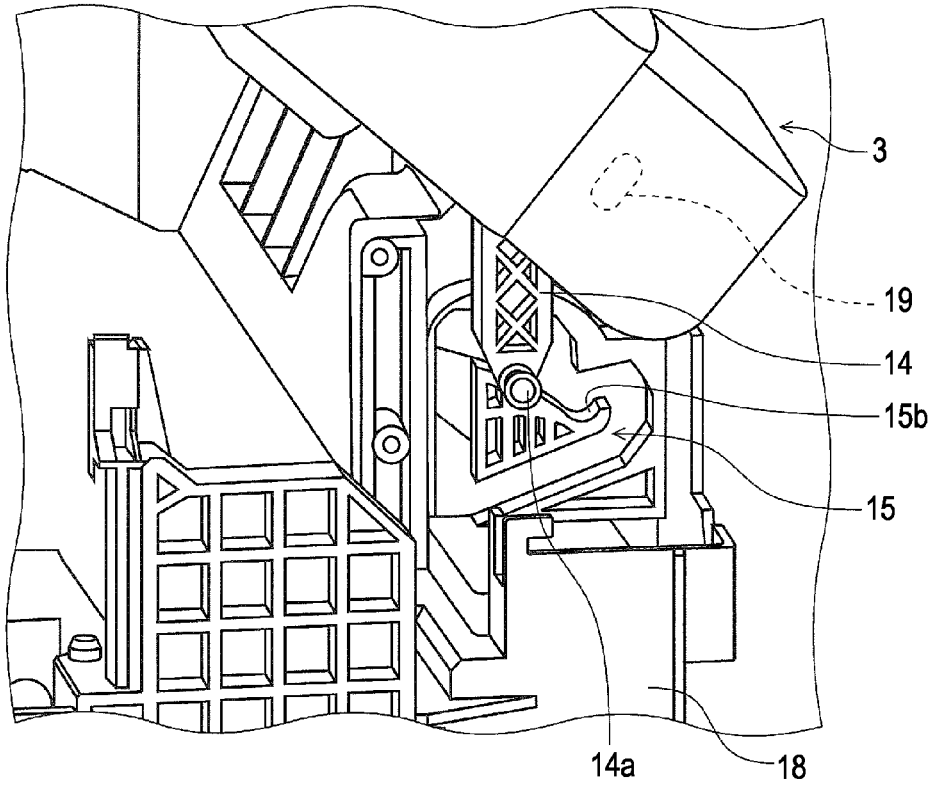
FIG. 6 is a perspective view illustrating an arm and a cam groove for maintaining an open posture of the scanner unit.
Figure 7:
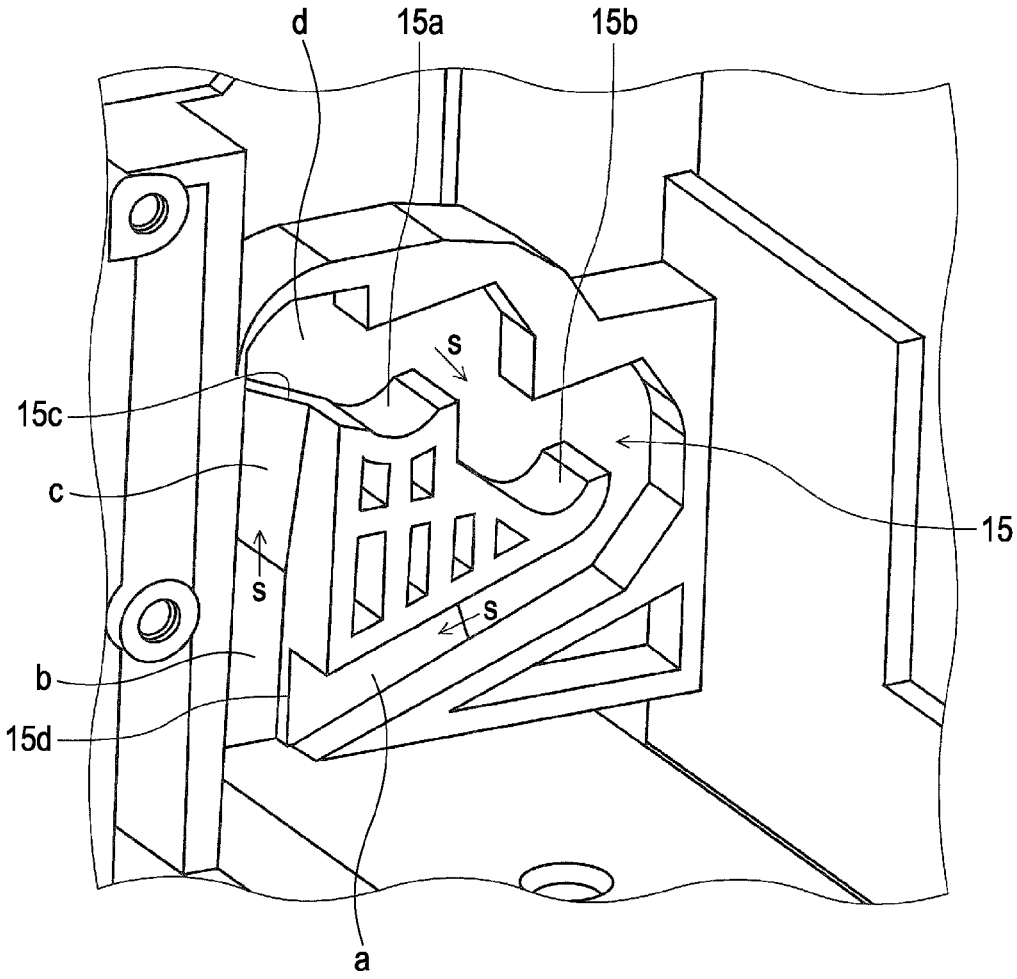
FIG. 7 is a perspective view illustrating the cam groove for maintaining the open posture of the scanner unit.

FIG. 1 is an external perspective view of an ink jet printer 1, which is an example of a recording apparatus according to the invention, in a scanner unit 3 closed state. FIG. 2 is an external perspective view of the ink jet printer 1 in a scanner unit 3 open state. In addition, FIG. 3 is a plan view of the scanner unit 3. FIG. 4 is a perspective cross-sectional view of the scanner unit 3 illustrated in FIG. 3 along section IV-IV. FIG. 5 is a perspective view illustrating a guided portion 32. FIG. 6 is a perspective view illustrating an arm 14 and a cam groove 15 for maintaining an open posture of the scanner unit 3 (i.e., the scanner unit 3 open state). FIG. 7 is a perspective view illustrating the cam groove 15 for maintaining the open posture of the scanner unit 3.

Figure 8:
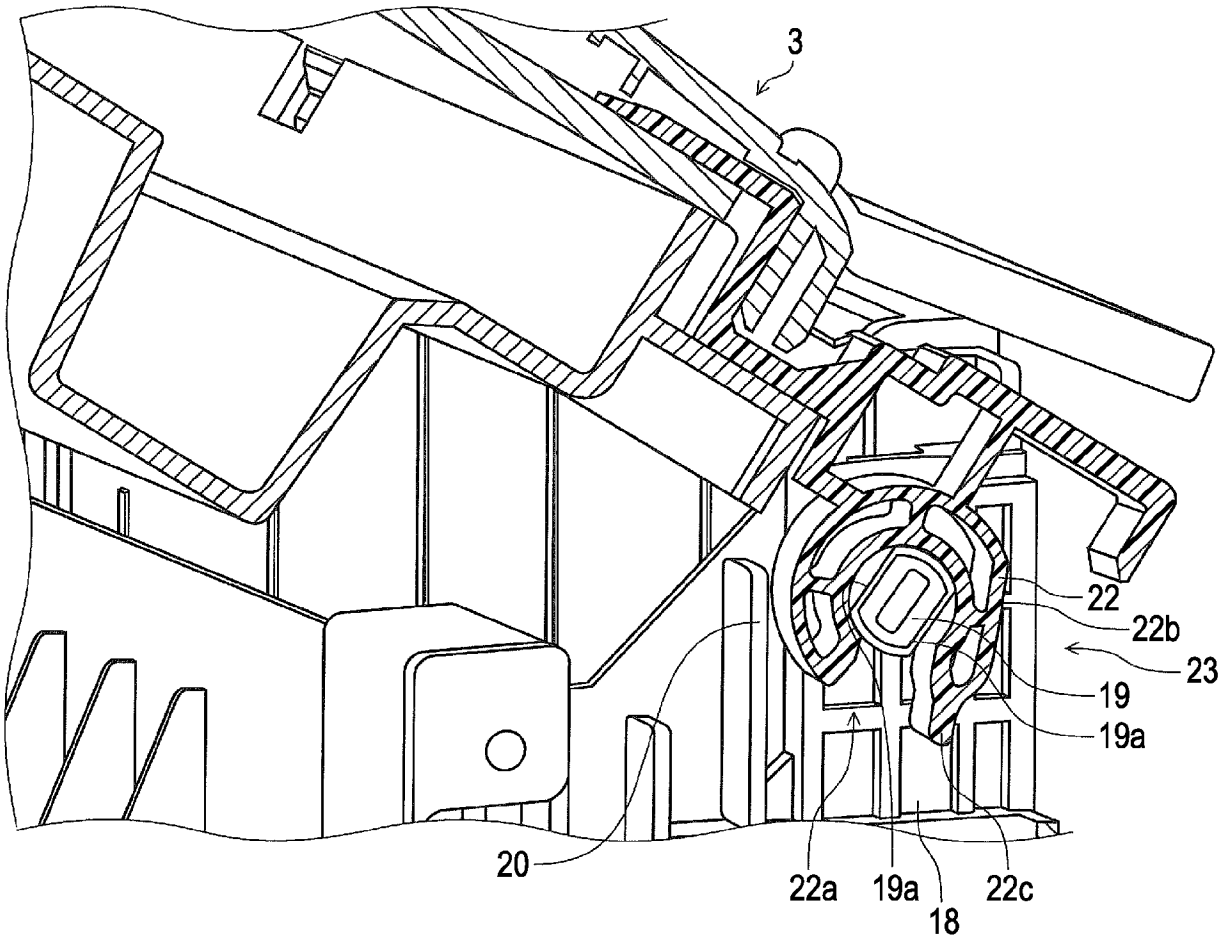
FIG. 8 is a perspective cross-sectional view of a shaft and a bearing for connecting a recording unit with the scanner unit.
Figure 9:
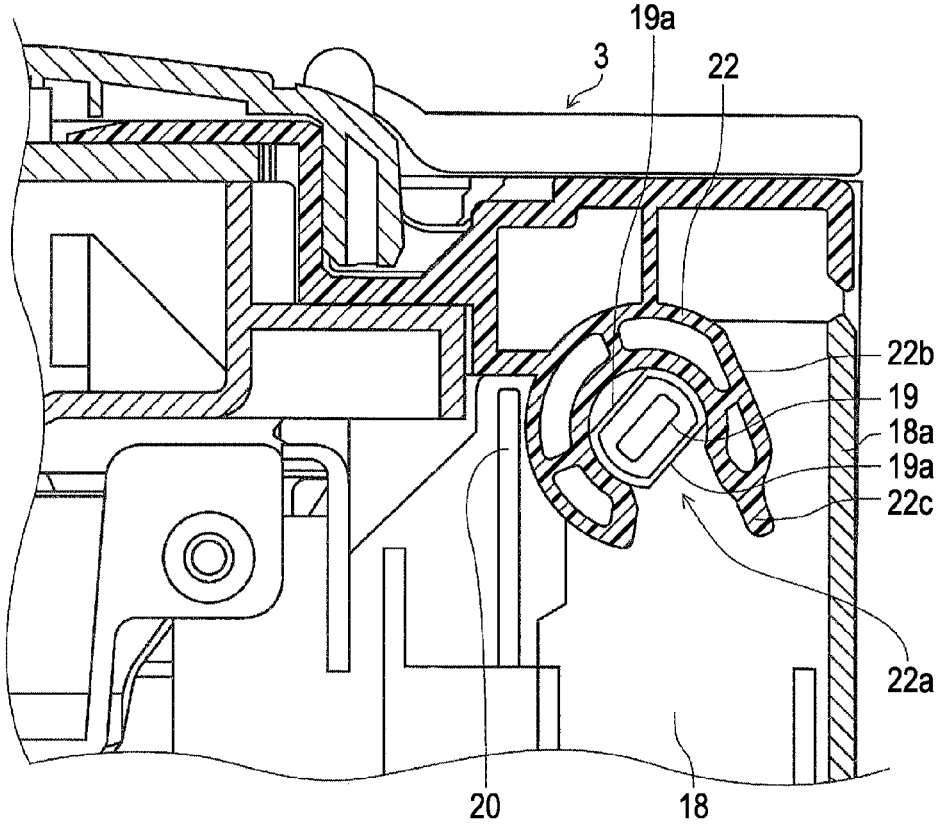
FIG. 9 is a cross section of the shaft and the bearing for connecting the recording unit with the scanner unit in the scanner unit closed state.
Figure 10:
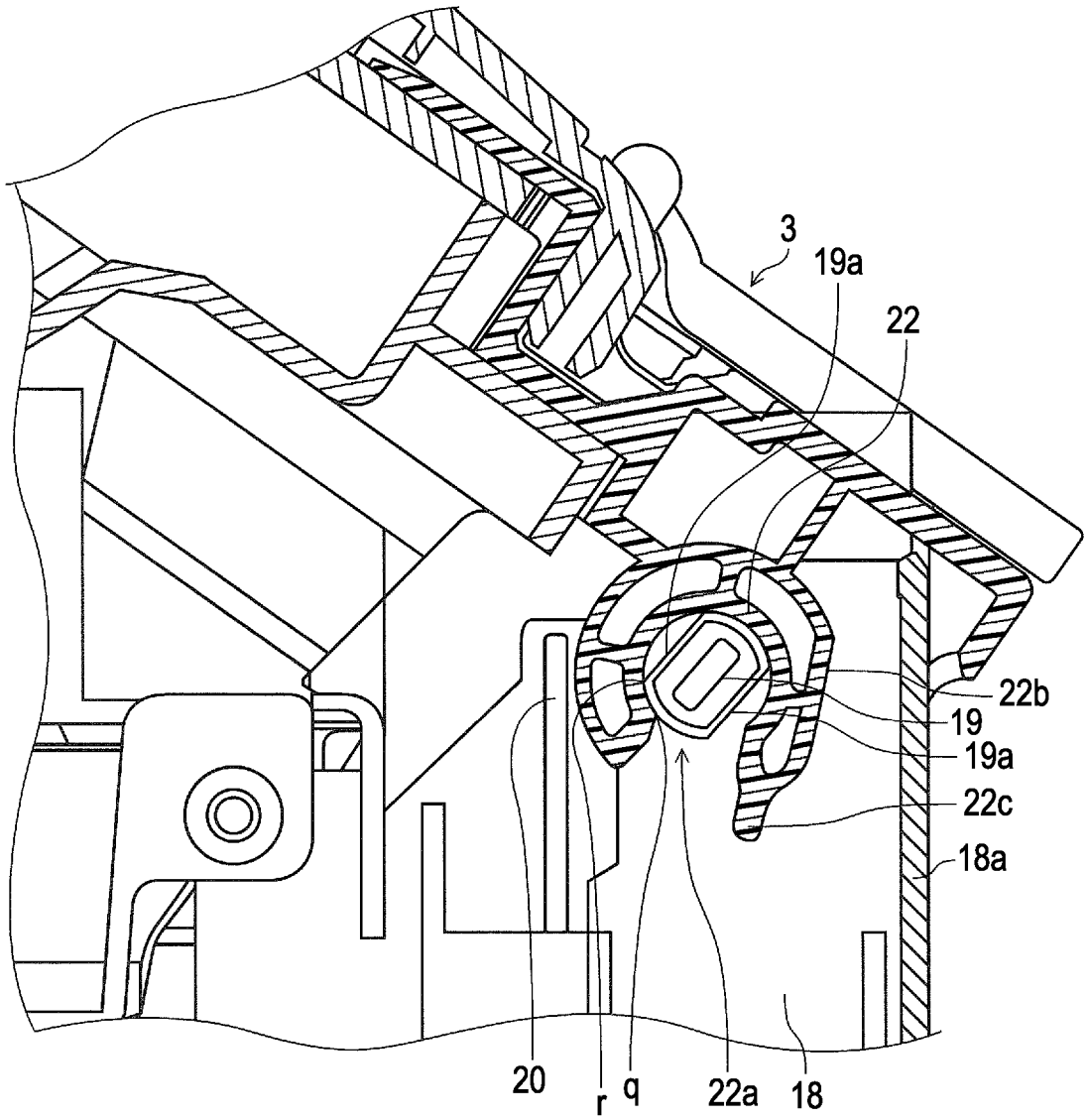
FIG. 10 is a cross section of the shaft and the bearing for connecting the recording unit with the scanner unit in the scanner unit open state.
Figure 11:
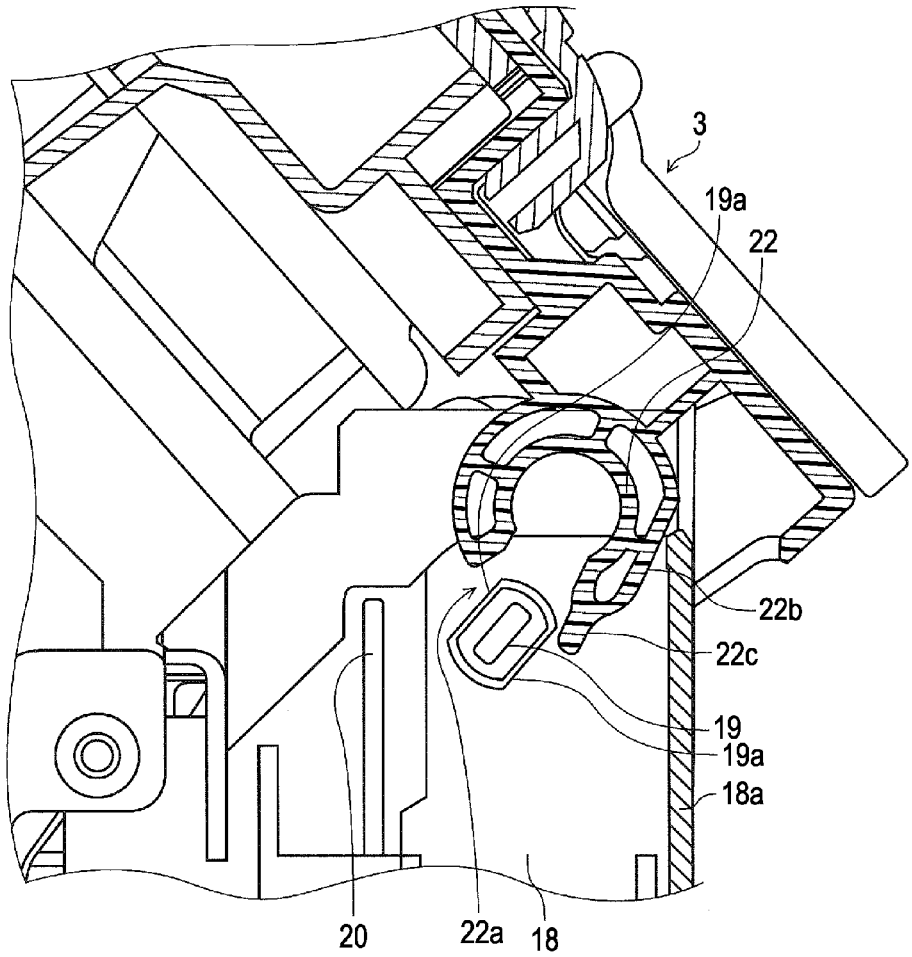
FIG. 11 is a cross section of the shaft and the bearing for connecting the recording unit with the scanner unit in an incomplete assembly state.
Figure 12:
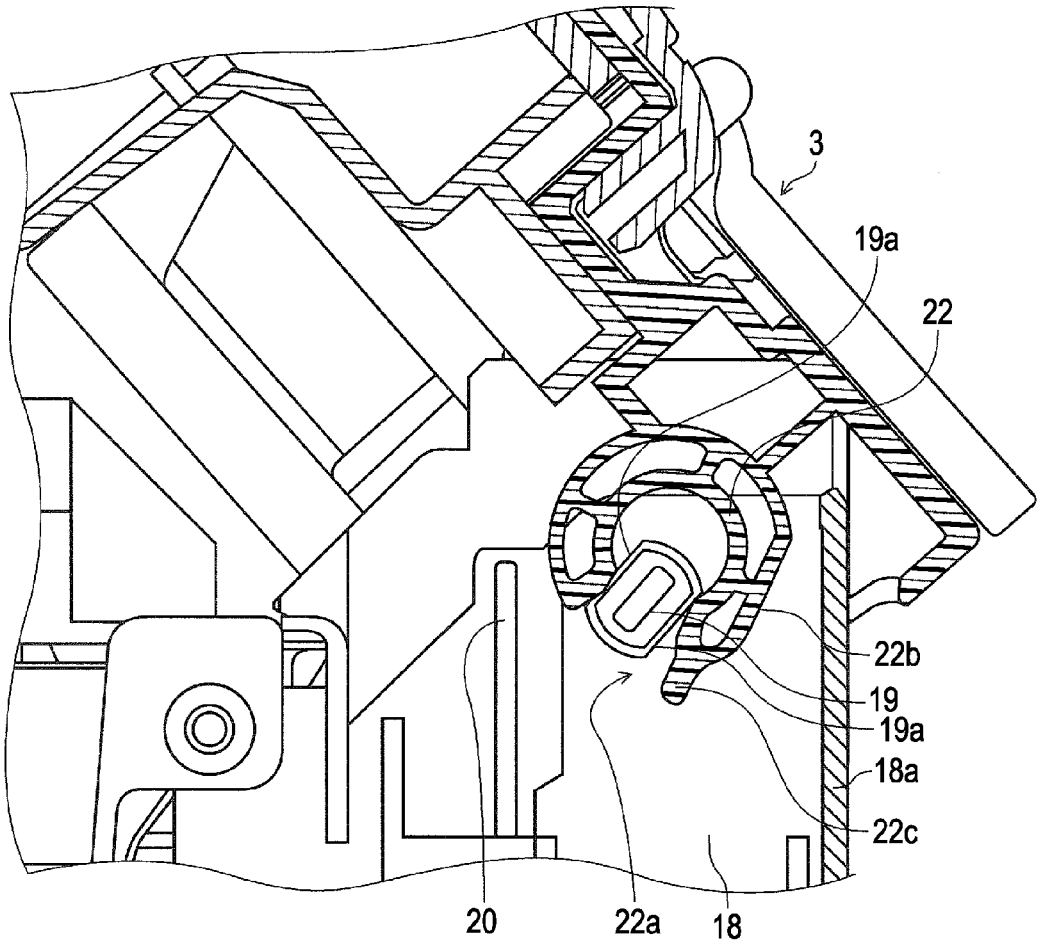
FIG. 12 is a cross section of the shaft and the bearing for connecting the recording unit with the scanner unit in the incomplete assembly state.
Figure 13:
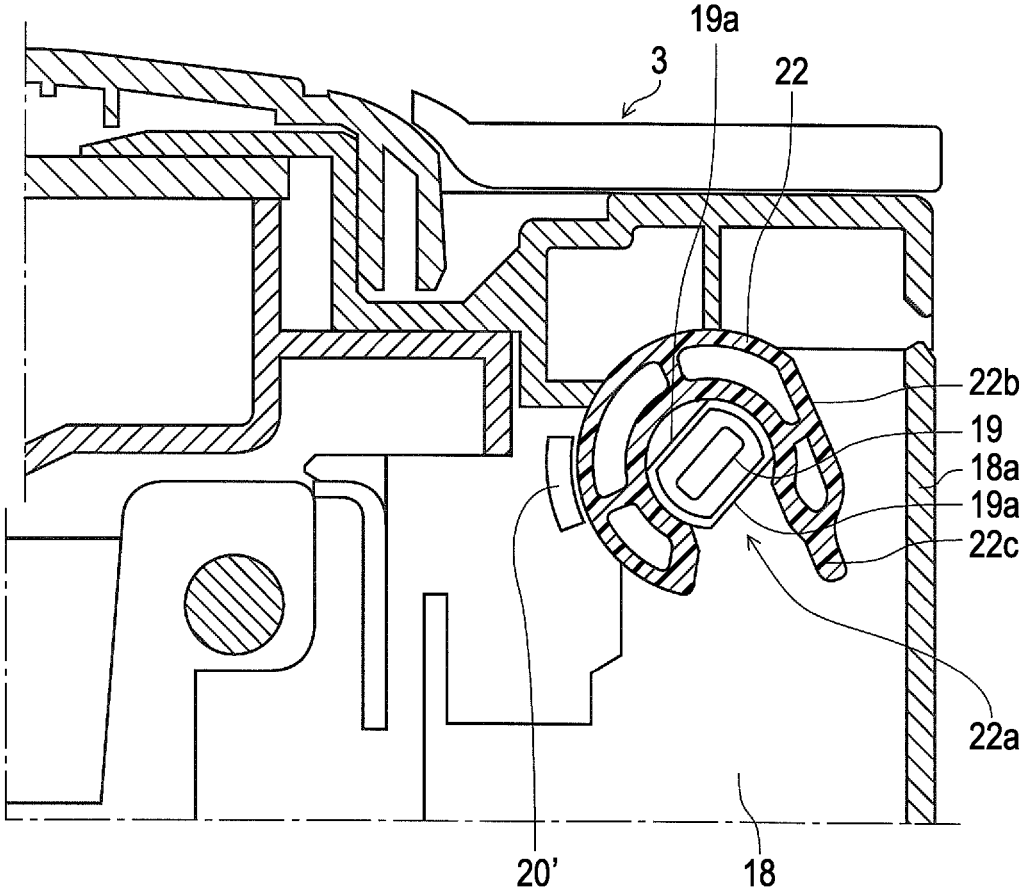
FIG. 13 illustrates another exemplary embodiment of a restricting portion in a cross section of the shaft and the bearing for connecting the recording unit with the scanner unit in the scanner unit closed state.

Furthermore, FIG. 8 is a perspective cross-sectional view illustrating a shaft 19 and a bearing 22 for connecting a recording unit 2 with the scanner unit 3. FIG. 9 is a cross section of the shaft 19 and the bearing 22 for connecting the recording unit 2 with the scanner unit 3 in the scanner unit 3 closed state. FIG. 10 is a cross section of the shaft 19 and the bearing 22 in the scanner unit 3 open state. FIG. 11 is a cross section of the shaft 19 and the bearing 22 in an incomplete assembly state. FIG. 12 is a cross section of the shaft 19 and the bearing 22 in the incomplete assembly state. Moreover, FIG. 13 illustrates another exemplary embodiment of a restricting portion in a cross section of the shaft 19 and the bearing 22 in the scanner unit closed state.

Referring to FIGS. 1 and 2, in the ink jet printer 1, the recording unit 2 configured to execute ink jet recording onto a recording sheet, which is an example of a medium, constitutes an apparatus body of the ink jet printer 1. The scanner unit 3, which is a "pivotable member", is provided in an upper portion of the recording unit 2. In other words, the ink jet printer 1 is configured as an MFP having a scanner function in addition to an ink jet recording function.

The scanner unit 3 is provided pivotably in relation to the recording unit 2. The posture of the scanner unit 3 can be shifted between a closed posture (the scanner unit closed state illustrated in FIG. 1) and an open posture (the scanner unit open state illustrated in FIG. 2) by tilting. By opening the scanner unit 3, a user of the ink jet printer 1 can replace an ink cartridge (not illustrated) installed in a carriage 11 and perform a jam removal operation, which is performed if a paper jam has occurred.

Referring to FIG. 2, a pivotable connecting portion 23 includes the shaft 19 and the bearing 22 (see FIG. 8), which will be described in detail later below. Note that the shaft 19 and the bearing 22 (FIG. 8) included in the pivotable connecting portion 23 are located at locations at which the shaft 19 and the bearing 22 cannot be seen by the user in a complete assembly state of the apparatus. Accordingly, FIG. 2 illustrates an approximate location of the pivotable connecting portion 23 in the entire apparatus. In addition, an arm 14 and a cam groove 15 (see FIG. 6) for maintaining the scanner unit 3 open state are provided. The arm 14 and the cam groove 15 will be described in detail later below.

Furthermore, an openable/closable top cover 4 is included in the scanner unit 3. When the cover 4 is opened, a document stand (not illustrated) of the scanner unit 3 appears. As illustrated in FIG. 3, a frame 25 constitutes a base of the scanner unit 3. A reading unit 30, which is a reading device, is provided on the frame 25 movably in a scanning direction (laterally in FIG. 3). Note that in FIG. 3, a glass plate included in the document stand and provided on the frame 25 is omitted.

A guide rail 26 guides the reading unit 30. A drive pulley 27 is driven by a motor (not illustrated). A driven pulley 28 is rotationally driven by the drive pulley 27. An endless belt 29 is stretched between the drive pulley 27 and the driven pulley 28. A carriage 31, which is included in the reading unit 30, is connected to the endless belt 29. With the above-described configuration, when the endless belt 29 travels, the reading unit 30 moves in the scanning direction.

The carriage 31 includes a guided portion 32. The guided portion 32 is guided by the guide rail 26. As illustrated in FIG. 4, the guided portion 32 has such a concave shape that the guided portion 32 is fitted to the convex-shaped guide rail 26 from above. As illustrated in FIG. 5, convex portions 32*b* and 32*c* are formed on an inside 32*a* of the guided portion 32. With the above-described configuration, a lubricant retaining portion 32*d* is formed between the convex portions 32*b* and 32*c*.

A lubricant, such as grease, is charged into the lubricant retaining portion 32*d*. With the above-described configuration, the guided portion 32 can smoothly slide along the guide rail 26 and smooth sliding of the guided portion 32 can be secured for a long period of time due to the lubricant that seeps through the lubricant retaining portion 32*d* for a long period of time.

Returning to FIGS. 1 and 2, a paper discharge tray 6, onto which a sheet having an image recorded thereon is discharged, is provided in a front portion of the apparatus. The paper discharge tray 6 has a drawer-like configuration. FIGS. 1 and 2 respectively illustrate a state in which the paper discharge tray 6 is stored inside the body of the ink jet printer 1.

An operation unit 9 includes a power switch, operation buttons for executing various print settings and recording, a display unit configured to display contents of the print settings and a preview image of an image to be printed, and the like. A panel unit 8 includes the operation unit 9. The panel unit 8 is provided to the scanner unit 3 and is displaced integrally with the scanner unit 3 as the scanner unit 3 is tilted.

As illustrated in FIG. 2, a recording head 12 is provided to the carriage 11 on a bottom thereof. Recording on a sheet is executed by ejecting ink from the recording head 12 while the carriage 11 is moved in a direction of the width of the sheet. Note that a transport unit (not illustrated) configured to transport a sheet is provided upstream of the recording head 12 in a paper transport path. In addition, a paper feed unit (not illustrated) configured to feed a sheet to the transport unit is provided upstream of the transport unit in the paper transport path.

The arm 14 and the cam groove 15 for maintaining the scanner unit 3 open state will be described in detail below. Referring to FIG. 6, the arm 14 is pivotably supported by the scanner unit 3 on a side of one end (upper end side) thereof. On the side of the other end (lower end side) of the arm 14, a boss portion 14*a* is formed so that the boss portion 14*a* protrudes in a direction perpendicular to the plane of FIG. 6. In FIG. 6, the boss portion 14*a* has entered the cam groove 15.

A cam known as a heart cam is used for the cam groove 15. The boss portion 14*a*, which is formed onto the arm 14, moves in the cam groove 15 in a direction indicated by an arrow s (i.e., in a predetermined direction) in FIG. 7. The cam groove 15 is formed so that the height of the bottom surface of the groove is changed. For example, a step 15*d* is formed between bottom surfaces a and b. More specifically, the bottom surface b is lower than the bottom surface a by one step. In addition, a step 15*c* is formed between bottom surfaces c and d. More specifically, the bottom surface d is lower than the bottom surface c by one step. With the above-described configuration, the boss portion 14*a* cannot be displaced in the cam groove 15 in a direction opposite to the direction indicated by the arrow s.

A first recessed portion 15*a* and a second recessed portion 15*b* are formed in the cam groove 15. The boss portion 14*a* enters the first recessed portion 15*a* and the second recessed portion 15*b* to maintain the open posture of the scanner unit 3. FIG. 6 illustrates an exemplary state of the arm 14 when the scanner unit 3 is in a fully open state (the open posture). In this state, the arm 14 has entered the first recessed portion 15*a*. With the above-described configuration, the arm 14 supports the scanner unit 3 to maintain the fully open state of the scanner unit 3.

At the moment the scanner unit 3 is slightly tilted from the above-described state, the boss portion 14*a* disengages from the first recessed portion 15*a* and moves toward the second recessed portion 15*b* (i.e., in the direction indicated by an arrow s in FIG. 7). When the user releases the scanner unit 3, the boss portion 14*a* enters the second recessed portion 15*b*. By executing the above-described operation, a half-open state of the scanner unit 3 is maintained. Note that the arm 14 is urged by an urging portion (not illustrated) in an oscillation direction, in which the boss portion 14*a* moves toward the rear portion of the apparatus (i.e., toward the right side in FIG. 6). Further note that it is preferable that the boss portion 14*a* be urged in a direction in which the tip of the boss portion 14*a* contacts the bottom surface of the cam groove 15 or that the tip of the boss portion 14*a* remain in contact with the bottom surface of the cam groove 15.

Moreover, at the moment the scanner unit 3 is slightly tilted from a state in which the boss portion 14*a* has entered the second recessed portion 15*b* (i.e., from the scanner unit 3 half-open state), the boss portion 14*a* disengages from the second recessed portion 15*b*. Furthermore, at the moment the scanner unit 3 is tilted in a direction in which the scanner unit 3 closes, the boss portion 14*a* moves in the cam groove 15 in the direction indicated by the arrow s illustrated in FIG. 7. When the scanner unit 3 is fully closed, the boss portion 14*a* enters a region of the bottom surface b.

Because the present exemplary embodiment has the above-described configuration in which the open posture of the scanner unit 3 can be maintained merely by tilting the scanner unit 3, the user can change the posture of the scanner unit 3 with one hand only. Accordingly, the present exemplary embodiment can realize a high operability. In addition, because a plurality of (two in the present exemplary embodiment) recessed portions in which the boss portion 14*a* enters are provided, the posture of the scanner unit 3 does not change abruptly from the fully open state to the fully closed state. Accordingly, the present exemplary embodiment can prevent collision of the scanner unit 3 with the recording unit 2, which may occur if the scanner unit 3 is tilted forcefully.

The pivotable connecting portion 23 including the shaft 19 and the bearing 22 will be described in detail. Referring to FIG. 8, on a main frame 18, which constitutes the base of the recording unit 2, the shaft 19 is integrally formed in a rear portion thereof. Note that in the present exemplary embodiment, the main frame 18 is made of a resin material and the shaft 19 is integrally formed on the main frame 18 by resin molding.

On the other hand, the bearing 22 is provided to the scanner unit 3. When the bearing 22 engages the shaft 19, the scanner unit 3 becomes pivotable in relation to the recording unit 2. FIGS. 11, 12, and 10 illustrate the changing state of the bearing 22, the state changing in the order of the figures, when being engaged with the shaft 19.

The bearing 22 is made of a resin material and has an opening 22*a*. Accordingly, when engaging the bearing 22 with the shaft 19, the user holds the scanner unit 3 and pushes the bearing 22 downward in a slanting direction from the rear to the front of the apparatus (i.e., from right to left in FIG. 11) to bring the bearing 22 close to the shaft 19.

In this configuration, the shaft 19 has a shape whose outer periphery is partially cut out (in a portion 19*a*) and the chord (the flat portion) formed by the cutout extends in the direction of engagement of the bearing 22 with the shaft 19 (in the direction that is downward and to the left in FIG. 11). Accordingly, only a small amount of elastic deformation of the bearing 22 is required when engaging the bearing 22 with the shaft 19. As a result, the present exemplary embodiment can improve the ease with which the bearing 22 can be engaged with the shaft 19.

In addition, the outer periphery of the bearing 22 is also partially cut out (in a portion 22*b*). Accordingly, when engaging the bearing 22 with the shaft 19, the present exemplary embodiment can prevent the interference of the bearing 22 with the top end of a rear wall 18*a*, which constitutes the main frame 18. With the above-described configuration, the present exemplary embodiment can improve the ease with which the bearing 22 can be engaged with the shaft 19.

In addition, a guiding portion 22*c* having a tongue-like shape and extending from the opening 22*a* toward the outside of the bearing 22 in the radial direction of the bearing 22 is formed on the bearing 22. With the above-described configuration, when engaging the bearing 22 with the shaft 19, the guiding portion 22*c* exerts its function of guiding the shaft 19 toward the inside of the opening 22*a*. Accordingly, the present exemplary embodiment can improve the ease with which the bearing 22 can be engaged with the shaft 19. In connecting the scanner unit 3 with the recording unit 2, an operator cannot see the shaft 19 and the bearing 22 from the front of the apparatus. Accordingly, with the guiding portion 22*c*, the operator can particularly easily connect the scanner unit 3 to the recording unit 2.

As described above, the bearing 22 can be easily engaged with the shaft 19. Furthermore, once the bearing 22 is engaged with the shaft 19, the bearing 22 does not easily disengage from the shaft 19.

In FIGS. 8 through 10, a restricting portion 20 is provided at a location opposing the outer periphery of the bearing 22 and is configured to restrict the deformation of the bearing 22 in the direction of expansion of the opening 22*a* of the bearing 22 within the range of tilt of the scanner unit 3 between its open posture (FIGS. 8 and 10) and its closed posture (FIG. 9).

Therefore, in the range of use of the scanner unit 3 (open/close range), i.e., in the range of tilt of the scanner unit 3 between the open posture and the closed posture, the deformation of the bearing 22 in the direction of expansion of the opening 22*a* is restricted. With the above-described configuration, the tight engagement of the bearing 22 with the shaft 19 can be maintained.

The range of use (the open/close range) of the above-described scanner unit 3 is restricted by the arm 14 and the cam groove 15 illustrated in FIG. 6. Accordingly, by disengaging the arm 14 from the cam groove 15, it becomes possible for the scanner unit 3 to tilt further upward compared with the open posture illustrated in FIGS. 8 and 10. When the scanner unit 3 is tilted further upward in the above-described manner, one lateral end of the opening 22*a* of the bearing 22 (a portion q illustrated in FIG. 10) is brought to a position close to an end edge of an arc-like portion of the shaft 19 (a portion r illustrated in FIG. 10) or can disengage from the arc-like portion of the shaft 19. Accordingly, the bearing 22 can be easily disengaged from the shaft 19 in this state.

Note that in the present exemplary embodiment, the restricting portion 20 is made of a linearly extending rib. However, it is also preferable that the restricting portion 20 be made of a rib having an arc-like shape formed along the outer periphery of the bearing 22, as illustrated in FIG. 13 as a portion 20'. With the above-described configuration, the present exemplary embodiment can appropriately restrict the deformation of the bearing 22 throughout a large extent of the outer periphery of the bearing 22.

Exemplary embodiments of the invention described above are mere examples and the invention is not limited to them. In particular, the "pivotable member" provided in the upper portion of the body of the recording apparatus is not limited to the scanner unit 3 described in the exemplary embodiment described above. More specifically, various units and apparatuses, such as a cover and an auto document feeder (ADF), can be used as the pivotable member. In addition, in the above-described exemplary embodiment, the shaft 19 is provided to the recording unit 2 and the bearing 22 is provided to the scanner unit 3. However, alternatively, the shaft 19 can be provided to the scanner unit 3 while providing the bearing 22 to the recording unit 2.

In addition, in the above-described exemplary embodiment, the invention is applied to the ink jet printer, which is an example of the recording apparatus. However, the invention can be applied to other general liquid ejecting apparatuses. More specifically, the liquid ejecting apparatus is not limited to a recording apparatus such as a printer, a copying machine, a facsimile apparatus, or the like, which uses an ink jet type recording head and executes recording on a recording medium by discharging ink from the recording head. That is, an example of the liquid ejecting apparatus is an apparatus which uses a liquid corresponding to the purpose of use of the apparatus instead of ink and ejects the liquid from a liquid ejection head equivalent to the above-described ink jet type recording head onto an ejection target medium equivalent to the recording medium to allow the liquid to adhere to the ejection target medium.

For the liquid ejection head, a color material ejection head used in manufacturing a color filter for a display such as a liquid crystal display (LCD), an electrode material (conductive paste) ejection head used in forming an electrode for a display such as an organic electroluminescent (EL) display, a surface light emission display, a field emission display (FED), and the like, a bioorganic matter ejection head used in manufacturing biochips, a sample ejection head which is a precision pipet, or the like can be used as an alternative to the recording head described above.

The entire disclosure of Japanese Patent Application No. 2012-011005, filed Jan. 23, 2012 is expressly incorporated by reference herein.

What is claimed is:

1. A recording apparatus comprising:

an apparatus body including a recording unit configured to execute recording on a medium;

a pivotable member provided pivotably in an upper portion of the apparatus body and whose posture can be shifted between an open posture and a closed posture by tilting;

a connection portion configured to connect the apparatus body with the pivotable member, the connection portion including a shaft and a bearing having an opening formed in one part thereof in a peripheral direction and engageable with the shaft by deforming in a direction of expansion of the opening occurring at the moment the bearing is engaged with the shaft; and a restricting portion configured to restrict deformation of the bearing in the direction of expansion of the opening within a range of tilt between the open posture and the closed posture of the pivotable member, at a location opposing an outer periphery of the bearing.

2. The recording apparatus according to claim 1, wherein the restricting portion has an arc-like shape formed along the outer periphery of the bearing.

3. The recording apparatus according to claim 1, wherein the shaft has a shape whose outer periphery is partially cut out.

4. The recording apparatus according to claim 1, wherein the bearing has a shape whose outer periphery is partially cut out.

5. The recording apparatus according to claim 1, wherein the bearing includes a guiding portion extending from the opening toward an outside of the bearing in a radial direction of the bearing and configured to guide the shaft toward an inside of the opening.

* * * * *